United States Patent [19]

Lu

[11] 4,047,943

[45] Sept. 13, 1977

[54] METHOD OF DEVELOPING ELECTROSTATIC LATENT IMAGES WITH CONDUCTIVE LIQUID DEVELOPER

[75] Inventor: Chin H. Lu, Webster, N.Y.

[73] Assignee: Xerox Corporation, Stamford, Conn.

[21] Appl. No.: 552,590

[22] Filed: Feb. 24, 1975

Related U.S. Application Data

[62] Division of Ser. No. 364,216, May 25, 1973, Pat. No. 3,907,694.

[51] Int. Cl.[2] ..... G03G 13/10

[52] U.S. Cl. ..... 96/1 LY; 106/30; 252/62.1 L

[58] Field of Search ..... 106/19–23; 101/451, 468–473; 252/62.1 L; 427/15, 16, 364, 216; 96/1 LY

[56] References Cited

U.S. PATENT DOCUMENTS

| | | | |
|---|---|---|---|
| 3,084,043 | 4/1963 | Gundlach | 96/1 |
| 3,290,251 | 12/1966 | Nelson | 252/62.1 L |
| 3,542,682 | 11/1970 | Mutaffis | 252/62.1 |
| 3,692,520 | 9/1972 | Mammino et al. | 252/62.1 L |
| 3,810,193 | 5/1974 | Metcalfe | 427/15 |

*Primary Examiner*—Theodore Morris

*Attorney, Agent, or Firm*—James J. Ralabate; Ernest F. Chapman

[57] ABSTRACT

A method and composition for development of a latent electrostatic image with a liquid developer is disclosed. The non-volatile, non-hygroscopic, conductive liquid developer has a viscosity suitable for convenient application to an imaged surface in the development of latent electrostatic images. The developer composition comprises a coloring agent, a binder, and a dispersing agent in triethylene glycol monobutyl ether.

11 Claims, No Drawings

METHOD OF DEVELOPING ELECTROSTATIC LATENT IMAGES WITH CONDUCTIVE LIQUID DEVELOPER

This is a division of application Ser. No. 364,216, filed May 25, 1973, now U.S. Pat. No. 3,907,694.

BACKGROUND OF THE INVENTION

This invention relates to electrostatic printing and more particularly to an improved ink and liquid developer composition for converting latent electrostatic images into visible images.

In electrostatic printing, latent electrostatic images are formed on a photoconductive surface of a recording element by uniformly charging the surface thereof, as by a corona discharge device, followed by exposure to light in the desired image pattern. Such images may be developed by solid (powder) developers or by liquid developers.

Liquid developer compositions for use with electostatic images generally comprise a dispersion of pigment or toner particles in a volatile, insulating liquid of high volume resistivity in excess of $10^9$ ohm-centimeters. Suitable insulating liquids include: aromatic hydrocarbons, such as benzene, toluene, and xylene; aliphatic hydrocarbons, such as, hexane, cyclohexane and heptane; freons and halogenated hydrocarbons and silicone oils. The liquid developer is applied to the imaged surface, and the suspended toner particles become electrostatically charged and develop the latent image by migration under influence of the image charge. This is known as electrophoretic development.

In another type of electrostatic image development disclosed by Gundlach in U.S. Pat. No. 3,084,043, liquid developers having relatively low viscosity, low volatility, contrast in color in the usual case with the surface on which it will remain, and relatively high electrical conductivity (relatively low volume resistivity), are disclosed for converting the electrostatic latent image to a visible image. According to this method liquid developer from a reservoir is deposited on a gravure roller and fills the depressions in the roller surface. Excess developer is removed from the lands between depressions, and as a receiving surface charged in image configuration passes against the gravure roller, developer is attracted from the depressions in image configuration by the charge. This method of development is referred to as polar liquid development.

Print quality is difficult to control when prior art water and alcohol based inks are used as liquid developers. Evaporation can be a problem with the volatile prior art liquid developers, and when a volatile, conductive liquid carrier or solvent is organic in nature, evaporation results in pollution of the surrounding air, a very undesirable charcteristic in view of the present day efforts to reduce or eliminate contaminants in the air.

The prior art liquid developers also are generally unsatisfactory from the standpoint of producing a permanent visible image which is free of smear or blurring especially when rubbed. This stems from the inability of the toner particles to become permanently fixed on the surface or in the fibers of the copy sheet. Other prior art liquid developers are somewhat hygroscopic and have a tendency to pick up moisture while standing and/or during application of the developer to the imaged surface thereby complicating the control of print quality and stability.

Certain non-epoxy ether-containing liquid developers in insulating carriers have been used in the development of electrostatic latent images. In U.S. Pat. No. 3,290,251 suitable ethers for use in insulating media include, for example, furane, dibutyl ether, diphenyl ether, ethylene glycol dimethyl ether, triethylene glycol dimethyl ether, ethylene glycol dibutyl ether, diethylene glycol diethyl ether and diethylene glycol dibutyl ether. However, these liquid developers are in a non-conductive, insulating medium, and therefore, they are not sufficiently conductive for use in the development of electrostatic latent images where the liquid developer is attracted to the image configuration without separation of the ingredients of the liquid developer. Furthermore, the developers disclosed therein are generally too volatile and tend to have varying compositions and properties due to evaporation. With these prior art compositions drying procedures must be used to permit evaporation of the solvent before the ink or developer becomes fixed to the substrate.

OBJECTS OF THE INVENTION

Accordingly, it is a principal object of the present invention to provide a method and composition for development of a latent electrostatic image with a liquid developer free from the inherent deficiencies and disadvantages of prior art compositions and methods.

It is another object of this invention to provide a stable, conductive, non-volatile liquid developer composition wherein difficulty in control of print quality is essentially eliminated.

Still another object of this invention is to provide a liquid developer composition which is conductive, non-hygroscopic, and non-volatile, the ingredients of which remain in suspension upon standing, and which do not separate from the carrier medium when applied to the image surface during development of the latent electrostatic image.

Another object of this invention is to provide an ink or liquid developer composition which does not require heating or drying to fix the composition to the surface upon which it is applied.

Still further objects and advantages of the novel liquid developer composition and method of the present invention will become apparent from the following more detailed description thereof.

SUMMARY OF THE INVENTION

I have discovered that the above objects may be carried out by developing the electrostatic latent image with a liquid developer or ink composition comprising a binder, a coloring agent, a dispersing agent and triethylene glycol monobutyl ether as the carrier or solvent. The invention lies in the discovery that when the ingredients are dispersed or dissolved in triethylene glycol monobutyl ether the resistivity is less than $10_8$ ohmcentimeters; the viscosity is within the range at which liquid developers may be easily applied to surfaces and generally from about 100 to 500 centipoises; the liquid is non-volatile and non-hygroscopic and does not separate upon standing; and the liquid migrates to the imaged surface without separation of the ingredients from the ether carrier to provide prints having excellent quality. The liquid developers of this invention when used in a copying process for the development of an electrostatic latent image, produce at a very low threshold voltage copies which exhibit unusually high contrast. I have found that the ink or liquid developer of my invention does not require any heating or drying to fix the composition to the surface to which it is applied.

I have also discovered a method for development of latent electrostatic images on a substrate which comprises positioning close, but spaced from the electrostatic latent image on said substrate, a conductive, nonvolatile liquid developer having at least one binder, at least one coloring agent and at least one dispersing agent in the carrier or solvent, triethylene glycol monobutyl ether; providing flow aiding elements in physical contact between said developer and said substrate; and applying a bias to said developer whereby said developer moves along said flow aiding elements and thereby develops said electrostatic latent image and becomes fixed to said substrate with little or no evaporation in the absence of heat.

DESCRIPTION OF THE PREFERRED EMBODIMENTS

It is critical in the practice of the present invention that the ingredients be dispersed or dissolved in the high boiling solvent, triethylene glycol monobutyl ether. The liquid developer composition comprises at least one binder, at least one coloring agent and at least one dispersing agent in the triethylene glycol monobutyl ether.

The triethylene glycol monobutyl ether, otherwise known as butoxytriglycol, has a vapor pressure less than 0.01 mm Hg at 20° C. and a volume resistivity of approximately $1.6 \times 10^7$ ohm-cm. The ink or liquid developer conductivity (resistivity) is mainly controlled by the triethylene glycol monobutyl ether, and the effects of binder, dispersing agent and coloring agent are generally relatively minor.

To provide a liquid developer composition in accordance with the present invention it is preferred that the composition comprise at least about 40% by weight of the triethylene glycol monobutyl ether, however, it is important only that the composition comprises a balance of triethylene glycol monobutyl ether when the coloring agent is about 10–20 weight percent, the dispersing agent is about 4–10 weight percent and the binder is about 10–20 weight percent, and the optional additives, such as plasticizer, are present in quantities up to about 40 weight percent.

In the preferred embodiments of the present invention, pigment particles are suspended in the liquid carrier triethylene glycol monobutyl ether and are maintained in suspension by the aid of a dispersing agent dissolved therein. A binder is dissolved in the triethylene glycol monobutyl ether. In general, the compositions of the present invention comprise about 5% to 25% of the coloring agent or pigment, about 1% to 10% of the dispersing agent, and about 5% to 30% of the binder in the triethylene glycol monobutyl ether carrier liquid or solvent. Preferred ink or liquid developer compositions comprise about 10–20% coloring agent, about 4–10% dispersing agent, about 10–20% binder and the balance triethylene glycol monobutyl ether. Percentages designated throughout the specification and claims are in weight percent.

The suspended pigment or the dissolved dye or both are employed in that amount necessary to provide the desired positive print or copy when applied to a surface. There must be a sufficient amount of dispersing agent to maintain the dispersed pigment in suspension; and there must be an amount of binder sufficient to bind the coloring agent to the substrate. One skilled in the art can determine a suitable amount of binder, pigment and/or dye and dispersing agent for preparing a composition in accordance with the present invention. The concentrations of the various ingredients may be adjusted to prepare a formulation suitable as a liquid developer for use in the development of electrostatic latent images as long as the composition remains fluid and retains the other described properties. In compositions of the type described herein gelation of the fluid occurs when certain additives are introduced into the composition and when certain of the ingredients are introduced into the composition at concentrations exceeding the limits in the above designated ranges. These gels have utility in certain printing operations, however, only those which retain a fluid consistency can be utilized as liquid developers for application to the imaged surface or its equivalent by gravure rolls or other applicators. One skilled in the art can adjust these parameters to provide compositions which remain fluid during the development process in the development of electrostatic latent images.

The amount of coloring agent, binder, and dispersing agent required to obtain the desired print or copy, the desired viscosity and the desired resistivity within the limits of the present invention depend to a certain extent upon the particular coloring agent, dispersing agent, and binder used in the triethylene glycol monobutyl ether. The most frequently useful ranges are described above. Suitable amounts of the particular ingredient for a particular ink or liquid developer can be readily determined by preparing several samples of the ink or liquid developer in question, adding different amounts of the particular ingredients to each of these samples and developing a standard electrostatic latent image with each of the so treated samples and comparing the print quality of each to determine the amount which provides the best results.

Suitable binders for use in the composition of the present invention include, for example, various resins and modified resins, such as, epoxy resins, phenolic resins, polyesters, and rosin esters. Certain preferred binders include modified phenolic resins, maleic rosin ester, modified rosin ester, glycerol ester of hydrogenated rosin, certain acrylic type resins, polyamide resins, and esterified wood rosin. Any binder which will bind the pigment to the substrate and will not adversely interfere with the conductivity of the liquid developer, the quality of the print, the viscosity of the composition or cause the composition to gel upon standing, may be used in the practice of the present invention.

Pigments and dyes well known in the art may be used in the ink or liquid developer composition. Generally, such pigments as channel carbon black, furnace carbon black, and certain colored pigments are preferred in the practice of the present invention. In certain instances, dyes, for example, Hecto Blue R (C.I. Basic Violet 3, constitution no. 42555), which are soluble in the triethylene glycol monobutyl ether, may be used in place of the pigment or in conjuction with the pigment. However, the toner particles or pigments of the liquid developer composition can be selected from a wide variety of solid particles. Suitable organic or inorganic materials are described in the Carlson Pat. No. 2,297,691, including talcum powder, aluminum-bronze, carbon dust and the like. The coloring agent may be in the form of pigment particles formulated of a suitable dyestuff or carbon black embodied in a resinous carrier. such as described in U.S. Pat. Nos. 2,907,674 and No. 2,891,911. The preferred amount of toner particles has been set forth above and is generally within about 5–20% by weight of the entire composition.

The dispersing agents for suspending or dispersing the pigment or coloring agent in the triethylene glycol monobutyl ether may be any of those agents which are generally utilized by one skilled in the art for dispersing such pigments in ink or liquid developer compositions. The amount of dispersing agent required to maintain the pigment in suspension in the triethylene glycol monobutyl ether may also be adjusted by one skilled in the art. A preferred class of dispersing agents are the polyvinyl pyrrolidones or the alkylated polyvinyl pyrrolidones. Alkylated polymers of heterocyclic N-vinyl monomers may also be utilized as dispersants in preparing the composition of the present invention. Examples of these polymers and other alkylated polymers of comparable monomers are described in the U.S. Pat. No. 3,542,682.

The ink or liquid developer compositions of the present invention are non-volatile. Non-volatile as used herein means that the vapor pressure is below about 0.01 mm Hg (at 20° C.).

The viscosity of the liquid developer or ink compositions of the present invention are between about 100 centipoises and 1,000 centipoises and are preferably below about 500 centipoises. The most preferred range for the viscosity of the ink or liquid developer of the present invention is about 250–500 centipoises at 25° C. If the viscosity of the ink or liquid developer is too high, the developer cannot be utilized in the development of latent electrostatic images in view of the fact that it will fail to migrate to the charged image configuration of the charged surface within the development time. On the other hand if the viscosity is too low, there will be too much liquid developer on the charged image area resulting in poor print quality.

The ink or liquid developer composition of the present invention must also be relatively non-hygroscopic when it is utilized in the development of latent electrostatic images, to prevent the absorption of moisture by the liquid developer with the resulting dilution of the developer by the moisture and a loss of viscosity within the range suitable for applying a liquid developer to the electrostatic latent image.

Other ingredients may be added to the ink or liquid developer composition of the present invention as long as such additives do not have a deleterious effect upon the conductivity, viscosity, and print quality. For example, certain plasticizers, such as dibutyl phthalate, diisodecyl adipate and triethylene glycol di(2-ethylbutyrate), may be added to the ink compositions.

Although the compositions of the present invention may be utilized in any type of liquid development of electrostatic latent images, one method for utilizing the composition of the present invention is disclosed by Gundlach in U.S. Pat. No. 3,084,043. In a method for the development of an electrostatic latent image on a substrate, the liquid developer composition of the present invention wherein the ingredients are dispersed or dissolved in triethylene glycol monobutyl ether, may be deposited upon a gravure type roller containing "lands" and "valleys" and positioned close to, but spaced from, the electrostatic latent image on the substrate. In such a method it is preferred that the liquid developer be removed by a suitable means from the "lands" of the gravure roll prior to the development of the electrostatic latent image on the substrate. Following this, a bias is applied to a developer so that the developer moves along the "valleys" of the gravure roll in the direction of the electrostatic latent image on the substrate in image configuration. Various modifications of this method may be made by one skilled in the art within the limits of the present invention which comprises applying in image configuration to the electrostatic latent image on a photoconductive layer, a non-volatile, non-hygroscopic liquid developer preferably having resistivity at 25° C. of less than about $10^9$ ohm-centimeters and a viscosity of about 100 to 1,000 centipoises at 25° C. and comprising about 10–20 weight percent of a coloring agent, about 4–10 weight percent of a dispersing agent, about 10–20 weight percent of a resin binder and the balance triethylene glycol monobutyl ether. Up to about 40 weight percent of the ink composition can also be a plasticizer.

Having described the basic ingredients of the composition of the present invention and the method by which the composition may be used, illustration will now be made of the formulation and use of various developing compositions representative of those of the present invention.

EXAMPLE I

A composition was prepared having the following ingredients: 12% channel carbon black, 6% polyvinyl pyrrolidone dispersing agent, 15% modified phenolic resin, and 67% triethylene glycol monobutyl ether. The composition exhibited unusually high contrast development characteristics and required very low threshold voltage when utilized in the development of an electrostatic latent image. The resistivity of the ink was $3.0 \times 10^7$ ohm-cm, and the surface tension of the ink was 33.0 dynes/cm; it had an optical density of the hand proof of 1.19 and a Brookfield viscosity of 169 centipoises at 25.5° C.

EXAMPLE II

A composition comprising 12.5% channel carbon black, 2.5% polyvinyl pyrrolidone dispersing agent, and 25% polyamide resin was dispersed or dissolved in 60% (by weight) ethylene glycol monobutyl ether. The composition had a resistivity of $6.7 \times 10^5$ ohm-cm., a viscosity of 190 cp at 25° C., and an optical density of 1.20, however, the composition was excessively volatile.

In the examples viscosities were determined on a Brookfield viscometer and values are given in centipoises. Measurements were made at 12 RMP, 30 RPM, and 60 RPM, and the values given in the examples below were measured at 30 RPM unless otherwise indicated. A No. 2 spindle was used for the tests.

In most of the examples given below the optical density was determined in a sample of the ink which was applied to a bond paper by a Pamarco Flexo Hand Proofer, allowed to dry, and measured with a Densichron Densitometer. The resistivity was measured in ohm-cm by using a manually balanced AC wheatstone bridge and a dnductivity cell of 0.01 cell constant.

EXAMPLE III

A composition containing 12% channel carbon black, 6% alkylated polyvinyl pyrrolidone dispersing agent having a molecular weight of 19,000 (weight average), and 15% modified phenolics resin (Beckacite 1102, Reichhold Chemicals, Inc.) in 67% triethylene glycol monobutyl ether had a resistivity of $3.6 \times 10^7$ ohm-cm, an optical density of 1.22 when applied as described above and a Brookfield viscosity of 191 centipoises at 25° C. The ink or liquid developer composition had excellent print density, low viscosity, low volatility and was fixed by absorption into paper. The surface tension of the ink was 33.0 dynes/cm.

EXAMPLE IV

A composition having the same ingredients as disclosed for the composition of Example III was prepared with the exception that the dispersing agent was polyvinyl pyrrolidone and the binder was the glycerol ester of hydrogenated rosin. The composition had an optical density of 1.15, a resistivity of $3.0 \times 10^7$ and a viscosity at 25° C. of 163 centipoises. This ink or liquid developer composition in triethylene glycol monobutyl ether also produced excellent print density on paper and is suitable for use as a conductive liquid developer in copying processes.

EXAMPLE V

A composition comprising 14% channel carbon black, 4% alkylated polyvinyl pyrrolidone dispersing agent, 16% maleic rosin ester, 26% triethylene glycol monobutyl ether and 40% triethylene glycol di(2-ethyl butyrate) plasticizer, was prepared. The composition had a resistivity of $1.9 \times 10^8$ ohm-cm, an optical density of 1.29 and a Brookfield viscosity of 376 centipoises at 25.3° C. The ink or liquid developer had excellent print density on paper, low volatility and a suitable viscosity for application by gravure-type rollers in the development of a latent electrostatic image. The composition did not take up and retain moisture upon exposure to a humid atmosphere.

The above examples demonstrate the non-volatile, non-hygroscopic, conductive liquid developers or inks of the present invention which may be useful for the visual development of latent electrostatic images formed on a photoconductive layer.

While the present invention has been described primarily with respect to the foregoing specific examples, it is to be understood that the present invention is in no way to be deemed as limited thereto, but must be construed as broadly as all or any equivalent thereof.

I claim:

1. A method for the development of latent electrostatic images on a substrate comprising positioning close, but spaced from the electrostatic latent image on said substrate, a non-volatile, non-hydroscopic, conductive liquid developer comprising about 5–25 weight percent of a coloring agent, about 1–10 weight percent of a dispersing agent, but 5–30 weight percent of a resin binder and the balance triethylene glycol monobutyl ether; and applying said non-volatile conductive liquid developer to said substrate from flow aiding elements in physical contact between said liquid developer and said substrate by applying a bias to said liquid developer whereby said liquid developer moves along the flow aiding elements and thereby develops said electrostatic latent image.

2. The method of claim 1 wherein the liquid developer further comprises up to about 40 weight percent of a plasticizer.

3. The method of claim 1 wherein the substrate is a photoconductive layer of a recording element.

4. The method of claim 1 wherein the conductive liquid developer has a resistivity at 25° C of less than about $10^9$ ohm-centimenters.

5. The method of claim 1 wherein the liquid developer has a viscosity less than about 1,000 centipoises at 25° C.

6. The method of claim 1 comprising applying a liquid developer having about 25 to 90 weight percent triethylene glycol monobutyl ether.

7. The method of claim 1 comprising applying a liquid developer to the substrate, said liquid developer comprising a dispersing agent selected from the group consisting of polyvinyl pyrrolidones and alkylated polyvinyl pyrrolidones.

8. The method of claim 1 wherein the liquid developer has a viscosity of about 100 to about 1,000 centipoises at 25° C.

9. The method of claim 1 wherein the coloring agent comprises 10–20 weight percent of the liquid developer.

10. The method of claim 1 wherein the dispersing agent comprises 4–10 weight percent of the liquid developer.

11. The method of claim 1 wherein the resin binder comprises 10–12 weight percent of the liquid developer.

* * * * *